US008974153B2

(12) United States Patent
Steffen

(10) Patent No.: US 8,974,153 B2
(45) Date of Patent: Mar. 10, 2015

(54) TAMPING DEVICE WITH SYNCHRONIZING DEVICE AND METHOD FOR SAME

(75) Inventor: Michael Steffen, Munich (DE)

(73) Assignee: Wacker Neuson Production GmbH & Co. KG, Munich (DE)

( * ) Notice: Subject to any disclaimer, the term of this patent is extended or adjusted under 35 U.S.C. 154(b) by 1 day.

(21) Appl. No.: 13/988,822

(22) PCT Filed: Nov. 21, 2011

(86) PCT No.: PCT/EP2011/005858
§ 371 (c)(1),
(2), (4) Date: May 22, 2013

(87) PCT Pub. No.: WO2012/069174
PCT Pub. Date: May 31, 2012

(65) Prior Publication Data

US 2013/0243534 A1 Sep. 19, 2013

(30) Foreign Application Priority Data

Nov. 23, 2010 (DE) ..... 10 2010 052 243

(51) Int. Cl.
*E02D 3/068* (2006.01)
*E02D 3/046* (2006.01)

(52) U.S. Cl.
CPC ..... *E02D 3/068* (2013.01); *E02D 3/046* (2013.01)
USPC ..... 405/271

(58) Field of Classification Search
CPC ..... E02D 3/068; E02D 3/046; E01C 19/288
USPC ..... 405/271
See application file for complete search history.

(56) References Cited

U.S. PATENT DOCUMENTS

| | | | | | |
|---|---|---|---|---|---|
| 3,534,669 | A | * | 10/1970 | Judd | 404/133.1 |
| 3,756,735 | A | | 9/1973 | Linz | |
| 3,865,501 | A | * | 2/1975 | Kniep | 404/133.05 |
| 4,170,427 | A | * | 10/1979 | Grane | 404/133.1 |
| 4,790,687 | A | * | 12/1988 | Wright | 405/182 |
| 5,562,365 | A | * | 10/1996 | Berrange | 405/271 |
| 6,004,076 | A | * | 12/1999 | Cook et al. | 405/271 |
| 6,065,904 | A | * | 5/2000 | Cook et al. | 405/303 |
| 6,213,681 | B1 | | 4/2001 | Sick et al. | |
| 6,722,815 | B2 | * | 4/2004 | Fervers | 404/75 |
| 8,256,987 | B2 | * | 9/2012 | Awrath | 404/133.1 |
| 2003/0156491 | A1 | | 8/2003 | Fervers et al. | |
| 2009/0208296 | A1 | * | 8/2009 | Cook et al. | 405/271 |
| 2010/0284743 | A1 | | 11/2010 | Steffen | |

FOREIGN PATENT DOCUMENTS

EP 0 998 609 A1 5/2000

* cited by examiner

*Primary Examiner* — Tara M. Pinnock
(74) *Attorney, Agent, or Firm* — Boyle Fredrickson, S.C.

(57) ABSTRACT

A tamping device for soil compaction having an upper mass with a drive and a lower mass that can be moved relative to the upper mass with a soil contacting element. In order to cause a working movement of the soil contacting element, a vibration generating device is provided. In addition to the vibration generating device, a manipulating device, for example in the form of a damping body, is provided in an operatively connected manner between the upper mass and the lower mass. The damping properties of the damping body can be modifiable.

14 Claims, 9 Drawing Sheets

TAMPING DEVICE WITH SYNCHRONIZING DEVICE AND METHOD FOR SAME

BACKGROUND OF THE INVENTION

1. Field of the Invention

The invention relates to a tamping device for soil compaction, in particular to a vibrating tamper.

2. Discussion of the Related Art

A tamper customarily comprises an upper mass having a drive and a lower mass which has a soil contact element and is movable relative to the upper mass. A tamping system (vibration-exciting device) which is drivable by the drive acts between the upper mass and the lower mass and can be used to bring about the working movement of the soil contact element. Tampers of this type are an indispensable aid on building sites. The function thereof is dependent on energy sources (a combustion drive or electric motor drive) and on countersinking (of the contact element with respect to the soil) and on the mechanical structures of the tamping system, such as, for example, the mass ratios of the moving and non-moving parts, the transmission ratios, the springs (steel or pneumatic), the dampers, the crank radii and the contact elements of the tamping system with respect to the soil.

It is known that tampers operate better on certain soils than on other soils. For example, a tamper first of all operates uniformly on a non-compacted, compactable soil, but, as the soil density increases, falls out of step. This "falling out of step" is expressed, for example, by an empty strike following three working strikes of the tamping foot (soil contact element) because the spring-mass system is no longer in synchronization. In the event of an asynchronous operation of this type, the passive system (upper mass, gripping frame for the operator) reacts with high amplitudes, which makes the guidability of the tamper more difficult.

In addition, the operator is put under considerable stress by the guiding of the tamper, wherein the hand-arm accelerations reach increased values and, as a result, reduce the permitted use period of the apparatus. In addition, the tamper operates at weak power and therefore the soil can scarcely still be compacted.

Furthermore, the mechanical system is highly stressed by the high movement amplitudes of the upper mass that occur during the asynchronous operation, which may result in the mechanical assemblies being overloaded and in the apparatus failing.

This non-uniform behavior of a tamper on different soils becomes all the more serious, the more power it is possible for the apparatuses to output into the soil. Apart from being determined by the drive itself, the power output is determined in particular by the masses, the tamping frequency and primarily by the strike of the tamping foot. In order therefore to be able to provide universally usable tampers, it is known to limit the stroke of the tamping foot to values at which the tamper can still be readily controlled. Impermissibly high movement amplitudes can thereby be avoided. On the other hand, however, the usable compaction power of the machine is also limited as a result because—given appropriately compactable soils—the entire power capacity of the tamper cannot be utilized.

DE 10 2007 048 980 A1 discloses a soil tamping device having adaptive drive regulation.

SUMMARY OF THE INVENTION

The invention is based on the object of providing a tamping device in which the synchronous operation of the masses involved can be prevented from being lost or can be restored by means of suitable measures in order to expand the use range of the tamper and to relieve the stress on the operator when guiding the tamper.

The object is achieved by a tamping device for soil compaction that comprises an upper mass having a drive, a lower mass which has a soil contact element and is movable relative to the upper mass, and a vibration-exciting device which is drivable by the drive and is intended for bringing about a working movement of the soil contact element. In addition to the vibration-exciting device, a manipulation device having a manipulation effect for influencing the movement behavior of upper mass and lower mass with respect to each other is provided in an operative connection between the upper mass and the lower mass.

The manipulation device can be designed, for example, as a damping device which, additionally to the vibration-exciting device (the actual tamping system) brings about additional damping of the spring-mass system.

By this mechanism, the vibrations occurring during the periodic movement from lower mass to upper mass are damped, which results in improved guidability of the tamper. The damping device can therefore act permanently or else can be switched on only when required. Similarly, the damping effect of the damping device can be changeable, wherein the term "damping effect" is also to be understood as meaning a state in which the damping device does not bring about any damping effect, i.e. in which the damping effect is zero.

In addition or alternatively, the manipulation device can be designed as a spring device and can thus enable a change in the spring effect between the upper and lower mass, as a result of which the movement behavior of the upper mass and lower mass with respect to each other can likewise be influenced.

The manipulation effect can be changeable by various measures, namely by an operator and/or by an intrinsic effect within the manipulation device, and/or by a control device activating the manipulation device. It is therefore possible to change the manipulation effect also by means of various measures which are provided alternatively or in addition to one another, in order to achieve the best possible adaptation to the particular operating state of the tamper.

In one embodiment, the manipulation effect, i.e. for example, the damping effect of the manipulation device, can be changeable by the operator, wherein an input device is provided for the operator for switching between at least two different manipulation effects of the manipulation device. It is therefore possible for the operator actively to switch the manipulation device on or off when a switch is intended to be made between a certain manipulation effect and no manipulation effect. Similarly, the operator can also make a choice between two or more manipulation effects and activate the latter when required. Similarly, it is possible to change the manipulation effect in a sliding manner by the operator expressing a corresponding requirement via the input device.

During operation, the operator, for example if, by jumping of the tamper, the operator has identified an undesirable operating state, in particular indicating the absence of synchronization, can improve the guiding behavior of the tamper by actuation of the input device and therefore adjustment of the damping between the upper mass and lower mass. In the ideal case, it is possible for the operator to restore the synchronization between the masses such that the tamper—then with the changed damping effect—can be guidable again normally and the operator can continue the work.

Depending on the configuration of the damping device, the adjustment of the damping may also result in a change in the spring behavior, as a result of which the movement behavior of upper mass with respect to lower mass is likewise influenced.

In addition or as an alternative, the manipulation effect of the manipulation device can be changeable by an intrinsic effect within the manipulation device. The manipulation device can have, in order to achieve the intrinsic effect, a magnet which is movable relative to a coil and in interaction with the coil, wherein the coil or the magnet is arranged on the upper mass and the other component in each case is arranged on the lower mass. Within the course of the relative movement of upper mass and lower mass, the coil and the magnet are therefore likewise movable relative to each other. By means of the interaction of coil and magnet, a magnetic interaction bringing about a dynamic effect, for example a damping of the relative movement, is produced in the tamping operation. By means of suitable configuration of the coil and magnet, the interaction can be determined in the desired manner, specifically even if the coil is not supplied with any current from the outside (for example via the control device).

An intrinsic effect can also be obtained in the manipulation device, for example, the damping device, by at least two magnets which are movable relative to each other, wherein the magnets are arranged distributed on the upper and on the lower mass. Upon the relative movement of upper and lower mass, the magnets are also moved with respect to one another, as a result of which magnetic forces (attraction and repulsion) have to be overcome, thus enabling a certain damping effect, but in particular a certain spring effect, to be achieved. The magnets are above all suitable for changing the spring stiffness acting between upper and lower mass.

A configuration of the manipulation device therefore makes it possible for the manipulation effect to be able to be changed automatically within the manipulation device depending on the synchronization behavior of the tamper without an intervention from the outside, either by the operator or by the control device or a regulating device being required.

As stated, the manipulation device can be in the form of a damping device and/or a spring device. In addition or alternatively, it may also, however, deploy other dynamic effects and may be realized, for example, as an actuator or actuating element.

A detection device may be provided for monitoring an operating behavior of the tamping device on the basis of the dynamic behavior of at least one component of the tamping device, and for identifying a deviation of the actual operating behavior from a predetermined desired operating behavior. The detection device is therefore suitable for differentiating between a synchronous tamping behavior (normal operation) and in particular an asynchronous tamping behavior (for example jumping of the tamper or excessively high movement amplitudes of the upper mass). The desired operating behavior therefore corresponds to the normal, desired operating behavior at which, for example, the movement of the upper mass moves within the scope of customary, permissible movement amplitudes.

The operating behavior deviating from normal operation can be identified in diverse ways by the detection device. For example, the detection device can have a vibration or acceleration sensor with which the vibration behavior of one or more components of the tamper is detected in order to draw conclusions therefrom about the operating behavior.

Similarly, it is possible for the detection device to be designed for monitoring a rotational speed of the drive and for identifying deviations of the rotational speed from the predetermined rotational speed behavior.

It has namely turned out that the load surges, which take place during the tamping, on the mechanical system of the tamper, can be detected via the variation in the rotational speed of the driving motor within a certain time range. The rotational speed jumps or the load change surges, on which the latter are based, or the driving motor are an indication of the pulsating power consumption of the tamping system. Due to the load surges of the tamping system, the rotational speed of the motor changes permanently. In the event of a regular exchange of forces of the tamping foot (soil contact element) with the soil, said changes are likewise regular (synchronous operation). During an asynchronous operation of the tamping system, in particular in the event of the empty strike described above, the empty strikes cause irregular ignition periods of the combustion engine and a non-uniform change in the engine rotational speed that lie outside the normal range. Corresponding irregularities can be determined in an electric motor.

It is therefore possible for the predetermined rotational speed behavior to take into account a regularity of rotational speed changes which occur because of active events provided according to specifications during the operation of the tamping device. The load surges occurring during normal operation and the resultant accelerations at the components of the tamper (in particular at upper and lower mass) and the permanent changes that are based thereon in the engine rotational speed are recognized as values provided within the permissible range. If, however, the actually determined values are detected outside the permissible range, this is evaluated as an indication of a tamping behavior which is no longer synchronous.

The findings of the detection device can be used in particular by the control device. For this purpose, the manipulation effect of the manipulation device can be changeable by the control device, wherein the manipulation effect, for example, the spring and/or damping effect, is changed by the control device on the basis of a deviation in the actual operating behavior from the predetermined behavior, which deviation is identified by the detection device, and of a predetermined control algorithm stored in the control device.

Thus, for example, the detection device can identify a deviation of the rotational speed of the drive from the predetermined rotational speed behavior and can thus cause the control device to change the spring or damping effect.

Owing to the fact that the detection device to this extent also monitors the control result of the control device, under some circumstances, complete regulation can thereby be realized with the aid of suitable regulating algorithms.

In one embodiment, an energy storage device can be provided, wherein the manipulation device has an energy transmission device, for transmitting and storing energy, which becomes free in order to obtain the manipulation effect, to and in the energy storage device. The energy which therefore customarily disperses, for example, in a damper can thereby be transmitted to the energy storage device and stored there for a certain time. When required, the energy can be retrieved again at a certain later time and returned to the movement operation. For this purpose, the manipulation device can be designed not only as a spring and/or damping device but also in the form of an actuator or a manipulator which first of all temporarily stores the energy during damping of a movement in the energy storage device and returns the energy again at a later time by means of a corresponding dynamic effect between upper and lower mass.

The storage and outputting of energy readily can be undertaken within a tamping cycle. The tamping foot can thereby be braked in a certain tamping phase and subsequently accelerated again, and therefore the movement of the tamping foot is detached in a certain manner from the requirements of the crank drive or of the tamping system. The displacement excitation, which was customary hitherto in the case of tampers, by the crank drive can therefore be supplemented by a superimposed effect of the manipulation device.

The energy transmission device can have an energy conversion device, for converting mechanical energy, which becomes free in order to obtain the damping effect, into an energy form which is storable in the energy storage device. In particular, it will make sense to convert the mechanical energy to electrical energy in order temporarily to store the energy.

The vibration-exciting device can have a crank device which is driven by the drive, a piston which is moved linearly to and fro by the crank device, and a spring device which is arranged between the piston and the lower mass.

It is possible to provide the damping device in the force flux parallel to the vibration-exciting device (tamping system) connecting the upper mass and the lower mass.

However, it is likewise also possible for the damping device to be arranged in the force flux between the vibration-exciting device and the soil contact plate. In this case, the damping device is connected in series with the vibration-exciting device. This permits a particular configuration of the tamping device.

In the case of a method for the tamping device for soil compaction, a manipulation device, for example, a damping device, is provided in an operative connection between an upper mass and a lower mass of the tamping device. It is possible to change the manipulation effect of the manipulation device depending on an operating behavior of the tamping device.

These and further features and advantages of the invention are explained in more detail below with reference to examples and with the assistance of the accompanying figures, in which:

DETAILED DESCRIPTION

Figure 1:
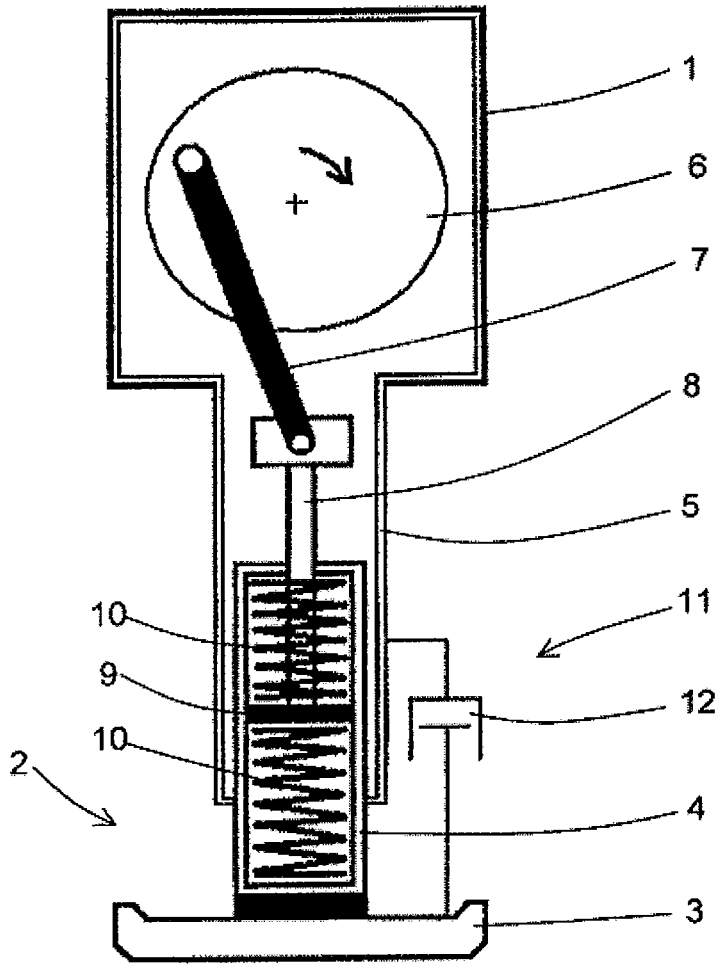
FIG. 1 shows a tamping device with a damping device.

FIG. 1 shows a tamping device (a tamper) for soil compaction. A tamping device of this type, which is also referred to as a vibrating tamper, has an upper mass 1 on which a driver (not illustrated), for example an electric motor or an internal combustion engine, is provided. A guide bracket or a guide frame (likewise not illustrated), with the aid of which an operator can guide and hold the tamper, can be fastened to the upper mass 1.

A lower mass 2, which in particular includes a tamping foot with a soil contact element 3, is provided below the upper mass 1. A guide tube 4 which likewise belongs to the lower mass 2 or to the tamping foot and is movable linearly to and fro in a guide tube 5 of the upper mass 1 is formed above the soil contact element 3.

The tamping movement of the lower mass 2 is produced on the basis of the movement of the latter to and fro with the aid of a tamping system (vibration-exciting device). For this purpose, a crank drive 6 which is driven in a rotating manner by the drive, and, via a connecting rod 7, moves a piston 8 to and fro is provided.

The piston 8 can be guided in the guide tube 5 and extends into the guide tube 4 of the lower mass 2 and ends at a piston disk 9. As seen in the axial direction, one or more springs 10 is or are arranged on both sides of the piston disk 9. The springs 10 may be pneumatic springs or, for example, also spiral springs made of steel.

During a movement of the piston 8 to and fro with the piston disk 9, the movement of the piston disk 9 is transmitted via the springs 10 or the corresponding spring assemblies to the guide tube 4 surrounding the springs 10 and the piston disk 9. As a result, the guide tube 4 follows the generally sinusoidal movement of the piston disk 9 with a certain delay. The guide tube 4 is rigidly connected to the soil contact element 3 and also the soil contact element 3 follows said movement and therefore produces the tamping effect on the soil to be compacted.

A tamper is known to this extent from the prior art.

Furthermore, a damping device 11 serving as the manipulation device is provided, said damping device connecting the upper mass 1 to the lower mass 2 independently of the tamping system and in particular independently of the spring 10. The damping device 11 is thereby arranged in an operative connection between the upper mass 1 and the lower mass 2.

In the simplest embodiment shown in FIG. 1, the damping device 11 can be a damping body 12 with a fixed tension and compression step for damping the spring-mass system of the damper. By this means, the vibrations occurring during an aperiodic relative movement between lower mass 2 and upper mass 1 are damped, which leads to improved guidability of the damper. In particular, it can thereby be prevented that the upper mass 1, and therefore also the guide bracket fastened thereto, execute successfully high movement amplitudes which cause particular stress on the operator, but also on the tamper material.

Figure 2:
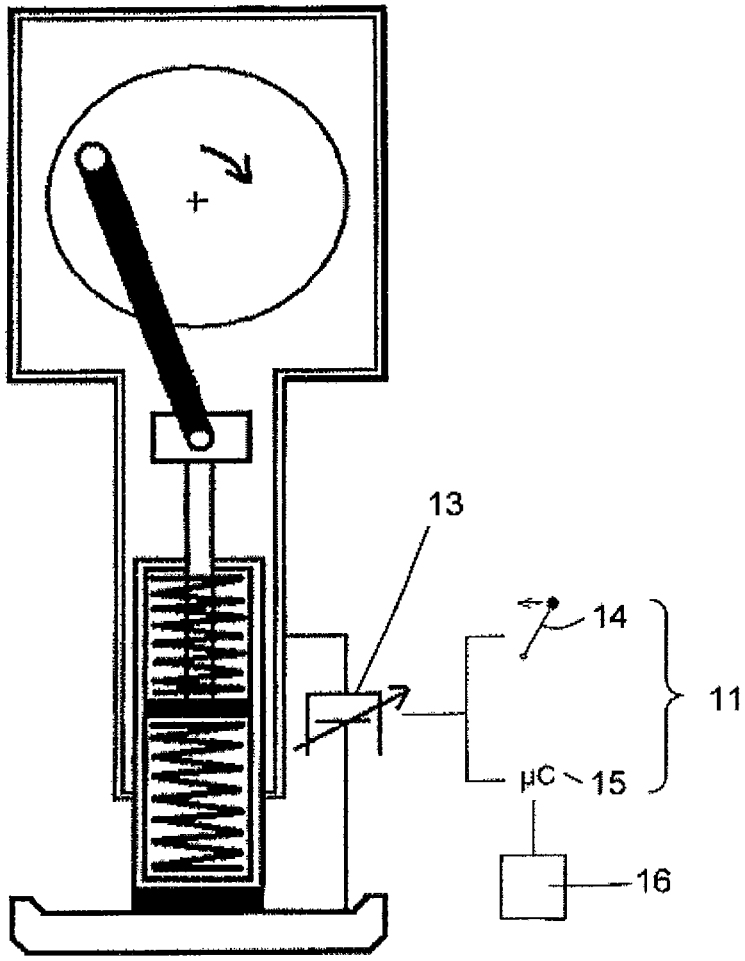
FIG. 2 shows a tamping device with a damping device with a changeable damping effect.

FIG. 2 shows another embodiment of a tamping device, wherein the mechanical design of the tamper substantially corresponds to that of FIG. 1.

The manipulation device 11 has a damping body 13, the damping properties of which are changeable. The damping of the damping body 13 can optionally be changed by an operator with the aid of an operating element 14 or by a controller 15.

The operator can therefore bring about a change in the damping of the damping body 13, for example manually via the operating element 14, if the operator determines that the tamper is no longer in synchronous operation (relative movement between upper mass 1 and lower mass 2).

For the controller 15, it is expedient to provide a state observer, for example in the form of a detection device 16, which, depending on a vibration or synchronization behavior of the tamper, controls a change in the damping effect of the damping body 13 when such a change is required.

The detection device 16 is merely shown in abstract form in FIG. 2 in the manner of a block diagram. However, like the operating element 14 or the controller 15, it makes sense if the detection device 16 is also arranged at a suitable location on the tamper itself. It is therefore not absolutely required by the illustration of FIG. 2 for the components—the operating element 14, controller 15 and detection device 16—to have to be provided spatially separated from the actual tamper.

The detection device 16 can be realized in various ways. It is thus possible, for example, to realize the detection device 16 with the aid of one or more movement acceleration sensors (also vibration sensors) in order to observe the movements of the vibration behavior of individual components of the tamper. The acceleration sensors can be arranged, for example, on the upper mass 1 or on the lower mass 2. Similarly, the relative movement between the upper mass 1 and lower mass 2 can also be detected.

By means of suitable evaluation of the detected parameters, the detection device 16 can identify whether the upper mass 1 and the lower mass 2 are in synchronous operation, which is provided according to the operation, or in an undesirable asynchronous operation. For this purpose, of course, permissible tolerance ranges within which the vibration behavior may still change, have to be defined. Only when the permissible tolerance is exceeded does the detection device 16 identify an asynchronous behavior of the tamper and can take suitable countermeasures via the controller 15.

In one variant, the load surges, which take place during the tamping, on the mechanical system of the tamper, can be detected via the variation in the rotational speed of the drive motor over a certain period of time. On the basis of the load surges provided according to the operation, a change in the motor rotational speed is brought about during each phase, this being caused by the pulsating power consumption of the tamping system on account of the pulsating power output to the soil to be compacted. The rotational speed jumps or the load change surges on the driving motor are therefore a consequence of said pulsating power consumption.

In the event of a regular exchange of forces of the tamping foot (soil contact element 3) with the soil, which exchange of forces is provided according to the operation, the changes in the motor rotational speed are also regular. However, in the event of undesirable empty strikes of the tamping system, the motor rotational speed also changes irregularly, and therefore a conclusion can be drawn regarding such empty strikes and therefore an asynchronous operating behavior of the tamper from a change in the motor rotational speed that is no longer regular.

For this purpose, the detection device 16 can detect the motor rotational speed, for example, via the control processor of the ignition system of the driving motor or via another electronic device and can draw conclusions regarding an empty strike, in particular in the event of irregular ignition periods of the internal combustion engine.

Figure 3:
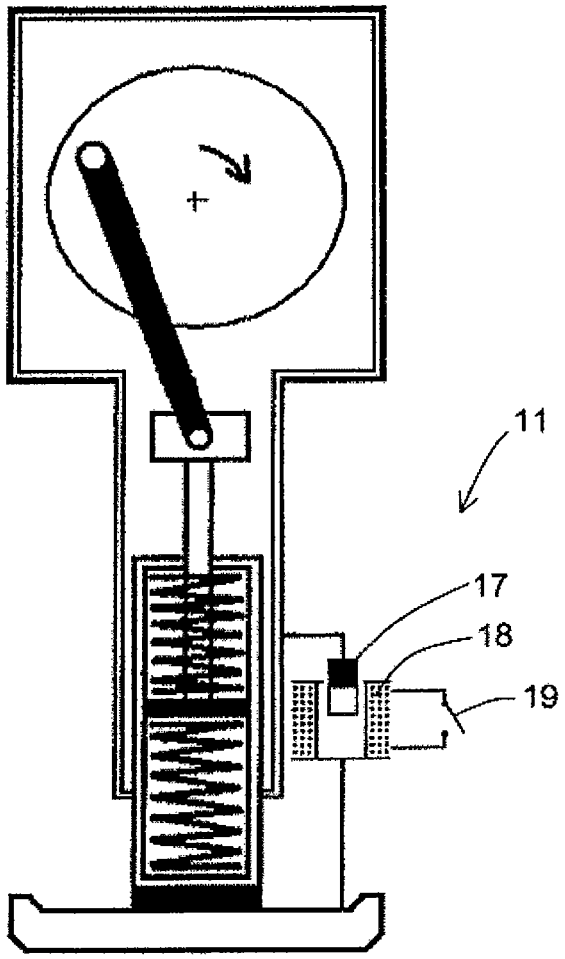
FIG. 3 shows another embodiment of the tamping device.

FIG. 3 shows a tamping device in which the manipulation device 11 is realized by a magnetic damping system, in which a magnet 17 is moved to and fro in a coil 18.

The coil 18 can be switched on and off via a switch 19 such that the magnetic field opposing the magnet 17 changes. The damping effect of the manipulation device 11 can thereby be changed.

Similarly, it is possible, instead of the switch 19, to provide resistors or electronic circuits via which the damping behavior can be changed.

In one variant, the coil terminals can be closed via the switch 19. On the basis of Lenz's law, the penetrating magnet 17 produces a current flow in the coil 18, as a result of which, in turn, a magnetic field is generated, said magnetic field opposing the magnetic field of the magnet 17. A damping effect can thereby also be obtained.

Figure 4:
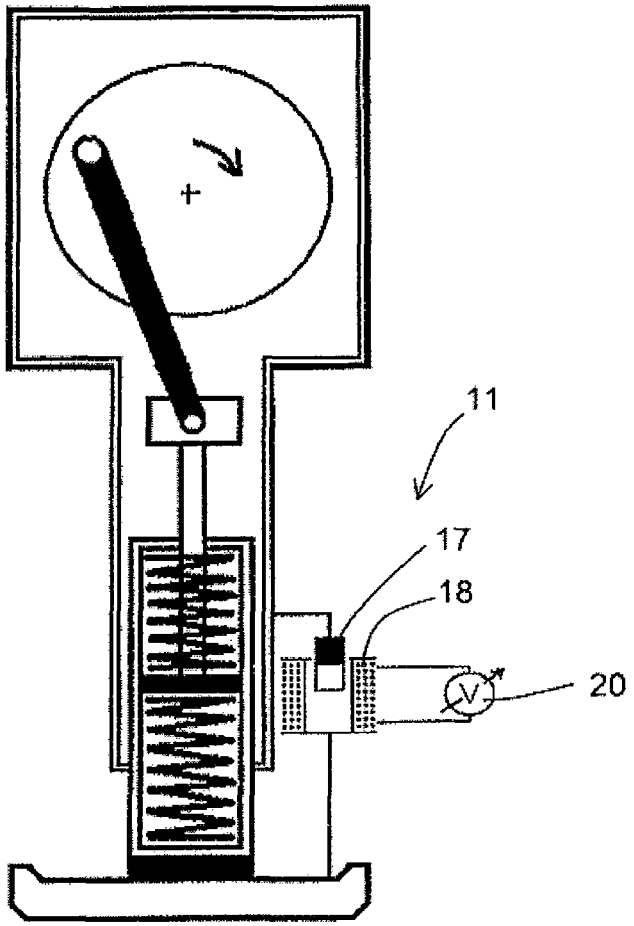
FIG. 4 shows a further tamping device.

FIG. 4 shows a variant of FIG. 3, in which the current in the coil 18 is also combined with a current 20 fed into the coil 18 and the magnetic effect thereof can thereby be changed. Such an arrangement can also be constructed with a magnetically conductive body which moves relative to the set of coils 18, wherein, then, for moderation, a current is to be fed in from the outside.

Figure 5:
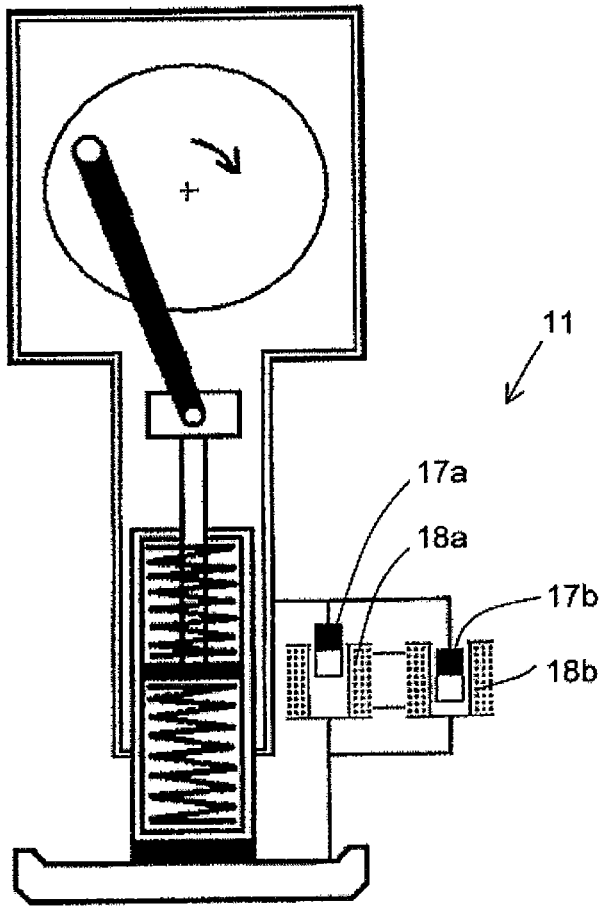
FIG. 5 shows a tamping device according to a further embodiment.

FIG. 5 shows a further variant with a first magnet 17*a* and a second magnet 17*b* and with a first coil 18*a* and a second coil 18*b*.

In this variant, the coils 18*a*, 18*b* are electrically coupled to each other such that the penetration of one of the magnets 17*a*, 17*b* into the respectively associated coil 18*a*, 18*b* generates a current which produces a certain effect in the other coil 18*a*, 18*b*.

A desired damping effect can be achieved by skillful combination of the coils 18 and magnets 17.

Figure 6:
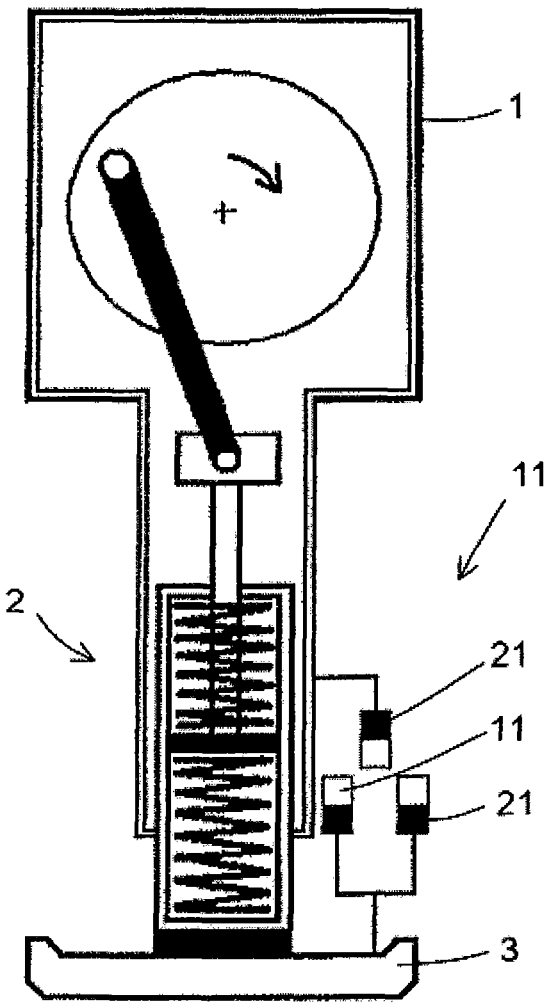
FIG. 6 shows a tamping device according to another embodiment.

FIG. 6 shows a further embodiment of the tamper with a manipulation device 11 which is formed by an arrangement of a plurality of magnets 21.

The manipulation device 11 therefore has at least one magnetic circuit which moderates the sequence of movements between the lower mass 2 and the upper mass 1 in such a manner that the temporal profile of the tamping movements with respect to one another can be changed, as a result of which an increase in the impact speed can be obtained before the tamping foot or soil contact element 3 strikes against the soil.

In this case, it is possible that—as shown in FIG. 6—at least two magnets 21, which are coupled to the upper and lower mass 1, 2 and run counter to one another, upon approach toward one another produce magnetic forces which are combined in a suitable manner with the forces formed in the regular mechanical tamping system such that the dynamic effects of the soil contact element 3 on the soil are increased. The movement of upper mass 1 and lower mass 2 is therefore modulated by the repulsion and attraction of the magnets 21.

In particular, it is possible to brake the soil contact element 3 shortly before contact with the soil, but then to press said soil contact element 3 downward upon contact with the soil.

Figure 7:
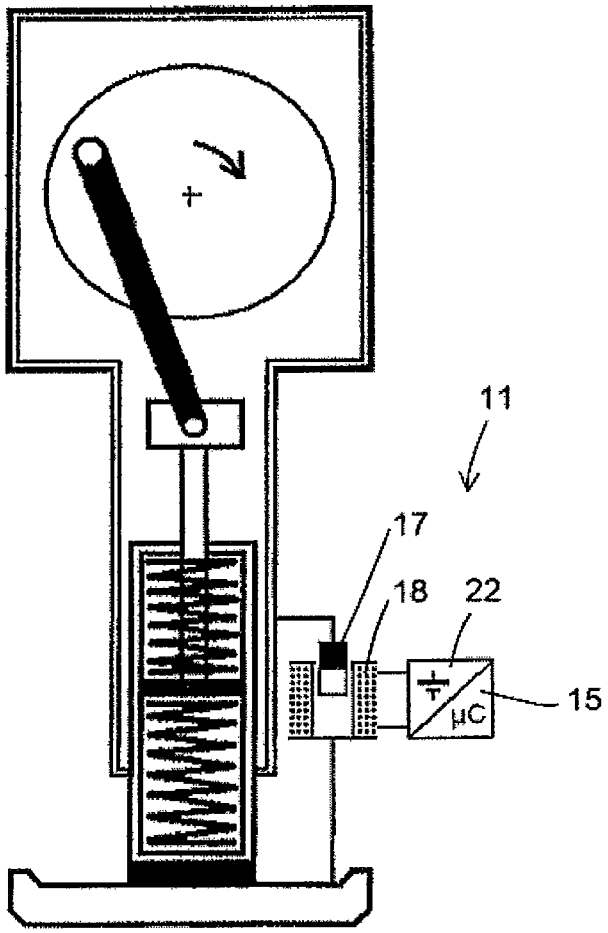
FIG. 7 shows a tamping device according to a further embodiment.

FIG. 7 shows a variant of a tamping device, in which, apart from the magnet 17 and the coil 18, the manipulation device 11 also has an energy storage device in the form of a battery 22. The battery 22 is activated in interaction with the coil 18 with the aid of the controller 15.

In this manner, the electrical energy, which becomes free by means of the damping during the operation of the manipulation device 11, is temporarily stored in the battery 22 (or in a corresponding capacitor) and can be returned again into the system at a different time. The magnet 17 in interaction with the coil 18 then serves not only as a damping element but also as a driving element such that the damping section or else a further section (not shown in FIG. 7) becomes the driving section which thereby brings about the synchronous operation of the masses.

With the aid of this system, an acceleration or braking of the lower mass 2 can be brought about at certain times, as a result of which sequences of movement are possible that the actual tamping system could not execute because of the purely mechanical effects thereof. Examples in this respect include: the moderation of the impact in respect of the strength and the duration; the production of a second strike after placing the soil contact element 3 onto the soil; the introduction of a counter force in the event of an undesirable reflection of the soil contact element 3 in the case of cohesive soils in order to counteract a springing-back of the lower mass 2.

Figure 8:
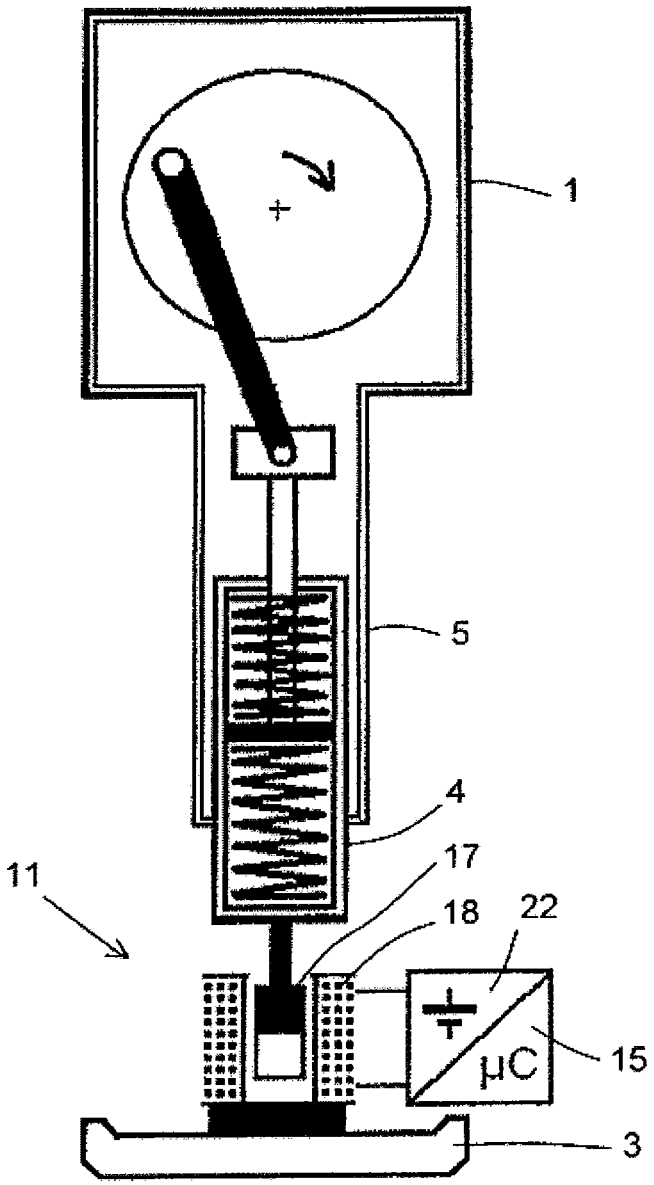
FIG. 8 shows a tamping device according to a further embodiment in turn.

FIG. 8 shows a variant of FIG. 7, in which the manipulation device 11 is arranged in series with the actual tamping system rather than parallel thereto. In this manner, the manipulation device 11—in the example shown with the magnet 17, the coil 18, the controller 15 and the battery 22—is arranged analogously to FIG. 7 in the force flux between the tamping system and the soil contact plate 3.

In this embodiment, it is not only the movement of upper mass 1 to lower mass 2 which is manipulated. On the contrary, the movement of the tamping foot or of the soil contact element 3 relative to the guide tube 4 thereof can be controlled.

Figure 9:
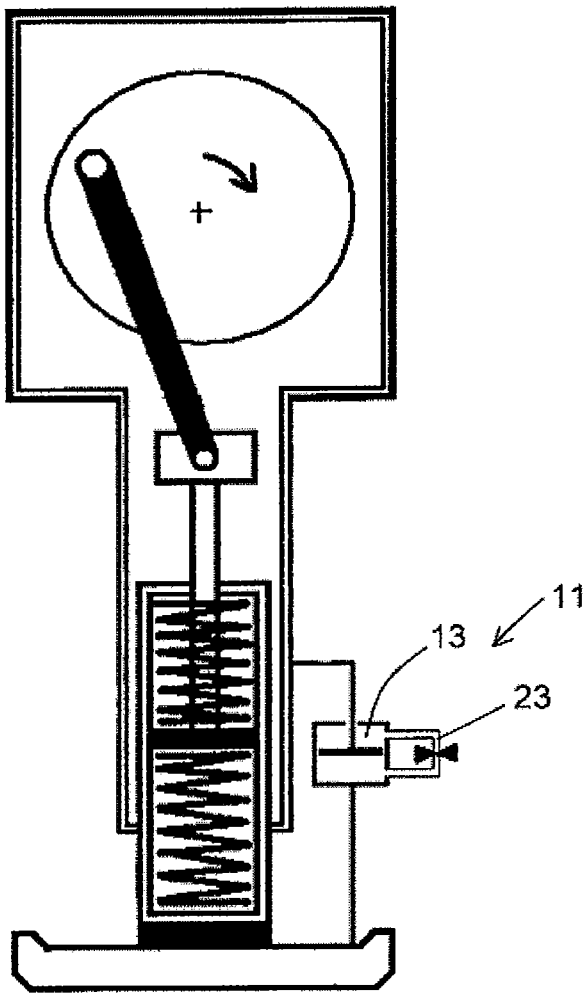
FIG. 9 shows a tamping device in a different embodiment.

FIG. 9 shows a variant of the embodiment of FIG. 2. In this case, the manipulation device 11 has the damping body 13, to the chambers of which a throttle device 23 is connected in parallel. The throttle device 23 therefore permits equalization of fluid between the chambers of the damping body 13. In this case, the throttle device 23 can be constant or changeable, wherein a changeable throttle device 23 permits an equalization of fluid, which is matched to the particular movement situation, in the damping body 13. Spring and/or damping effects can thereby be set in a specific manner.

The examples explained with reference to the figures merely show examples of proposals as to how the manipulation device 11 can be formed. Of course, other solutions, in which, for example, pneumatic dampers, hydraulic dampers or mechanical dampers are used between upper and lower mass 1, 2 are also conceivable. In addition, combinations of the dampers—also with the cooperation of magnets, coils, actuators and the like—are also possible in order to realize a certain movement or spring and/or damping behavior. It is therefore possible for a person skilled in the art, with knowledge of certain operating states which are determined, for example, by vibration frequencies and dynamic effects between upper and lower mass, to design a manipulation device which at least makes it possible to avoid or to reduce extreme forms of behavior such as, for example, jumping of the tamping device.

In addition, the damper can additionally have constant or changeable spring properties or can be combined with an additional spring device. It is thus also possible for the damping effect to be rather small or negligible such that the manipulation effect is substantially or exclusively achieved by the spring effect.

The adaptive influencing of the movements of the tamper masses involved in the exchange of forces brings about an adaptation of the movement behavior of said tamper to the surroundings. This leads to optimum working results and to quieter running of the tamping apparatus even in the event of heavily compacted soils. The hand-arm vibration values are thereby favorably influenced, and the guidability is improved in the case of cohesive soils. The tampers can thereby be configured to the power limits thereof (power capacity of the drive). By means of the adaptive moderation, tampers of this type also no longer fall out of step in the case of partially compacted or compacted soils.

The invention claimed is:

1. A tamping device for soil compaction, comprising
an upper mass having a drive;
a lower mass which has a soil contact element and which is movable relative to the upper mass;
a vibration-exciting device which is drivable by the drive and which brings about a working movement of the soil contact element; and
a manipulation device which produces a manipulation effect that influences the movement behavior of the upper mass and the lower mass with respect to each other, the manipulation device being provided in an operative connection between the upper mass and the lower mass; and
wherein the vibration-exciting device has a crank device driven by the drive, a piston which is moved linearly to and fro by the crank device, and a spring device which is arranged between the piston and the lower mass.

2. The tamping device as claimed in claim 1, wherein the manipulation effect of the manipulation device is changeable by at least one of
an operator,
an intrinsic effect within the manipulation device, and
a control device activating the manipulation device.

3. The tamping device as claimed in claim 1, wherein
the manipulation device is at least one of a damping device and a spring device; and wherein
the manipulation effect is at least one of a damping effect and a spring effect which is changeable.

4. The tamping device as claimed in claim 1, wherein
the manipulation effect of the manipulation device is changeable by the operator; and in wherein
an input device is provided for the operator for switching over between at least two different manipulation effects of the manipulation device.

5. The tamping device as claimed in claim 1, wherein
the manipulation effect of the manipulation device is changeable by an intrinsic effect within the manipulation device; and wherein
the manipulation device has, in order to achieve the intrinsic effect, one of
a magnet which is movable relative to a coil and which is in interaction with the coil, wherein one of the coil and the magnet is arranged on the upper mass and the other of the coil and the magnet is arranged on the lower mass, and
at least two magnets which are movable relative to each other, wherein one of the magnets is arranged on the upper mass and the other magnet is arranged on the lower mass.

6. The tamping device as claimed in claim 1, further comprising a detection device that monitors an operating behavior of the tamping device on the basis of the dynamic behavior of at least one component of the tamping device and that identifies a deviation of the actual operating behavior from a predetermined desired operating behavior.

7. The tamping device as claimed in claim 1, wherein
the manipulation effect of the manipulation device is changeable by a control device;
the manipulation effect is changed by the control device on the basis of a deviation of 1) the actual operating behavior from the predetermined desired operating behavior, which deviation is identified by a detection device, and of 2) a predetermined control algorithm stored in the control device.

8. The tamping device as claimed in claim 1 wherein
an energy storage device is provided;
the manipulation device has an energy transmission device, for transmitting and storing energy, which becomes free in order to obtain the manipulation effect, to and in the energy storage device; and wherein
upon return of the energy from the energy storage device to the manipulation device, a further manipulation effect is obtainable between the upper mass and the lower mass.

9. The tamping device as claimed in claim 8, wherein the energy transmission device has an energy conversion device for converting mechanical energy, which becomes free in order to obtain the manipulation effect, into an energy form which is storable in the energy storage device.

10. The tamping device as claimed in claim 1, wherein the manipulation device is arranged in a force flux between the vibration-exciting device and the soil contact element.

11. A tamping device for soil compaction, comprising an upper mass having no a drive:

a lower mass which has a soil contact element and which is movable relative to the upper mass:

a vibration-exciting device which is drivable by the drive and which brings about a working movement of the soil contact element: and a manipulation device which produces a manipulation effect that influences the movement behavior of the upper mass and the lower mass with respect to each other, the manipulation device being provided in an operative connection between the upper mass and the lower mass, and wherein the detection device monitors a rotational speed of the drive and identifies deviations of the rotational speed from a predetermined rotational speed behavior.

12. The tamping device as claimed in claim 11, wherein the predetermined rotational speed behavior takes into consideration a regularity of rotational speed changes which occur because of active events provided according to specifications during operation of the tamping device.

13. A method of operating a tamping device for soil compaction, comprising:

providing an upper mass which has a drive:

providing a lower mass which has a soil contact element and which is movable relative to the upper mass;

providing a vibration-exciting device which is drivable by the drive and which brings about a working movement of the soil contact element, wherein the vibration-exciting device has a crank device driven by the drive, a piston which is moved linearly to and fro by the crank device, and a spring, device which is arranged between the piston and the lower mass;

providing a manipulation device in an active connection between the upper mass and the lower mass; and changing a manipulation effect of the manipulation device depending on an operating behavior of the tamping device.

14. The method of claim 13, wherein the manipulation effect of the manipulation device is changed by at least one of an operator, an intrinsic effect within the manipulation device, and a control device activating the manipulation device.

* * * * *

UNITED STATES PATENT AND TRADEMARK OFFICE

CERTIFICATE OF CORRECTION

PATENT NO. : 8,974,153 B2
APPLICATION NO. : 13/988822
DATED : March 10, 2015
INVENTOR(S) : Steffen It is certified that error appears in the above-identified patent and that said Letters Patent is hereby corrected as shown below:

IN THE CLAIMS

CLAIM 11, Delete "no"

Col. 11, Line 7

Signed and Sealed this
Twenty-third Day of June, 2015

Michelle K. Lee

Michelle K. Lee
*Director of the United States Patent and Trademark Office*